United States Patent [19]

Tengsater

[11] 3,990,581

[45] Nov. 9, 1976

[54] EJECTOR MEANS FOR PRODUCE SORTER

[75] Inventor: Torsten Nils Tengsater, Takoma Park, Md.

[73] Assignee: AMF Incorporated, White Plains, N.Y.

[22] Filed: Feb. 3, 1975

[21] Appl. No.: 546,208

[52] U.S. Cl. ..... 209/74 R; 209/111.6

[51] Int. Cl.[2] ..... B07C 5/342

[58] Field of Search ..... 209/74 R, 74 M, 111.6

[56] References Cited

UNITED STATES PATENTS 3,581,888 6/1971 Kelly et al. ..... 209/74 R

FOREIGN PATENTS OR APPLICATIONS 58,411 10/1967 Germany ..... 209/74

*Primary Examiner*—Robert B. Reeves
*Assistant Examiner*—Joseph J. Rolla
*Attorney, Agent, or Firm*—George W. Price; John H. Gallagher

[57] ABSTRACT

An ejector for produce sorting apparatus including a drooping or sagging sheet of substantially air impervious material suspended in front of an air nozzle and adjacent the path of articles of produce moving along a free fall path. Upon occurrence of a reject signal from produce grading apparatus, an air blast impinges against the sheet to extend it to a taut condition into the free fall path to eject an article of produce.

4 Claims, 2 Drawing Figures

EJECTOR MEANS FOR PRODUCE SORTER

BACKGROUND OF THE INVENTION

In the automated sorting and grading of fruits and vegetables it is common practice to align the articles of produce in one or more rows on a moving conveyor belt and pass the articles past an inspection position where they are graded according to color and/or some other characteristic. When grading according to color, as is done with tomatoes and apples for example, a light source and light responsive means commonly are located adjacent the end of the conveyor belt. Produce which has acceptable color characteristics, as determined by color grading means associated with the light responsive means, is permitted to follow a free fall path from the discharge end of the conveyor. From there the produce is passed to another conveyor, or to a bin. If the color of an article of produce is other than the optimum color desired, the color grading means produces a reject signal which is coupled to a solenoid to open a pneumatic valve. An air nozzle directs a jet of high pressure air, or other fluid, across the free fall path of the article and deflects it out of the free fall path onto a third conveyor or into another bin assigned to the less than optimum articles. Apparatus of this type is quite common and further description is believed unnecessary.

Because the articles of produce being sorted usually are somewhat round in shape and have smooth surface contours, a significant portion of the air blast from the nozzle tends to follow around the smooth curved surface of the article so that the full force of the air blast is not effectively acting against the article to deflect it from its free fall path. This requires that the source supplying the air blast be relatively large to assure that the quantity and pressure of the air blast are sufficiently large to obtain the required force acting against the article of produce.

SUMMARY OF THE INVENTION

In the present invention more efficient use is made of the air blast and greater force is transmitted to the article of produce to be deflected from the free fall path by employing in front of the air nozzle a thin, flexible, substantially air impervious flap or open sheet of material which is deflected outwardly into the free fall path by the air blast. The article to be separated strikes the taut flap and is deflected away from the free fall path. In the absence of a reject signal from the grading means, no air blast is produced and the flexible material sags or droops to a position away from the free fall path so as to allow the acceptable articles of produce to continue along the free fall path.

DETAILED DESCRIPTION OF PREFERRED EMBODIMENT

Figure 1:
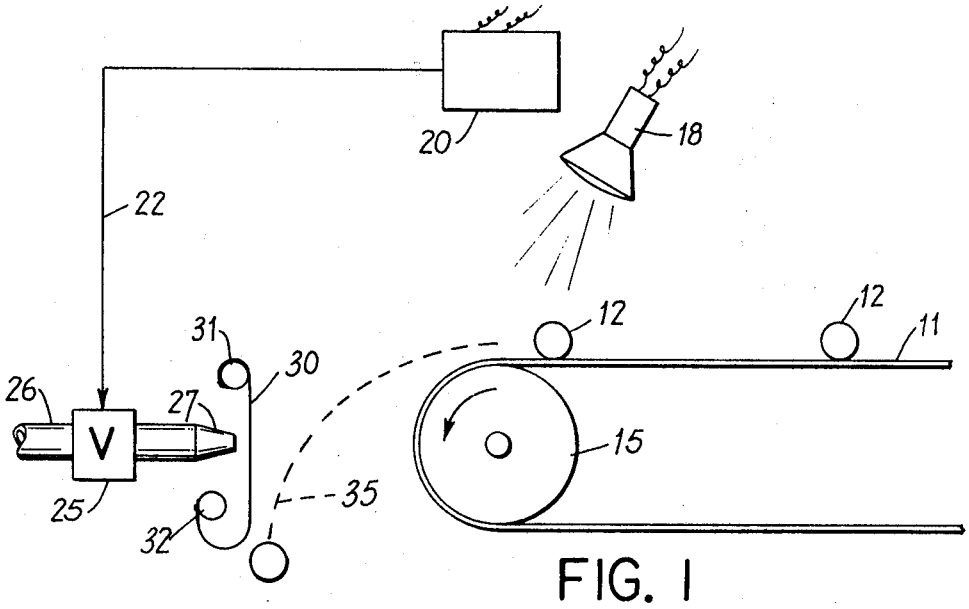
FIG. 1 is a simplified illustration of produce grading apparatus employing air blast means for ejecting articles of produce, and with the flexible flap of this invention in its relaxed and inoperative position.

In FIG. 1, an endless conveyor belt 11 carries articles 12 of a fruit or vegetable in single file to the discharge end of the conveyor where the belt passes around pulley 15. As the articles successively reach an inspection position at or adjacent the discharge end of conveyor belt 11, they are illuminated by light source 18 and the light reflected therefrom is received by color grading means 20, for example. If the article of produce at the inspection position has acceptable characteristics, no reject signal is produced on output lead 22 by grading means 20. The details of the grading means 20 form no part of the present invention and will not be described. Many types of produce grading apparatus are known and may be employed to grade the produce according to any desired characteristic.

Output lead 22 is coupled to a control solenoid of a hydraulic valve means 25 which controls the passage of a fluid such as air under pressure from a supply line 26 to a jet nozzle 27. The nozzle is disposed adjacent the discharge end of the conveyor 11 and aligned to direct an air blast across the free fall path of fruit falling from the conveyor.

In accordance with this invention a flexible open sheet or flap 30 of a substantially air impervious material is suspended in front of nozzle 27. Sheet 30 may be attached to rods 31 and 32 as illustrated, or other suitable suspension means may be employed. Sheet 30 may be made of rubber, canvas, leather, or any plastic material.

As illustrated in FIG. 1, in the absence of an air blast from nozzle 27, sheet 30 is in its relaxed condition wherein it sags or droops downwardly out of the free fall path 35 of the produce.

Figure 2:
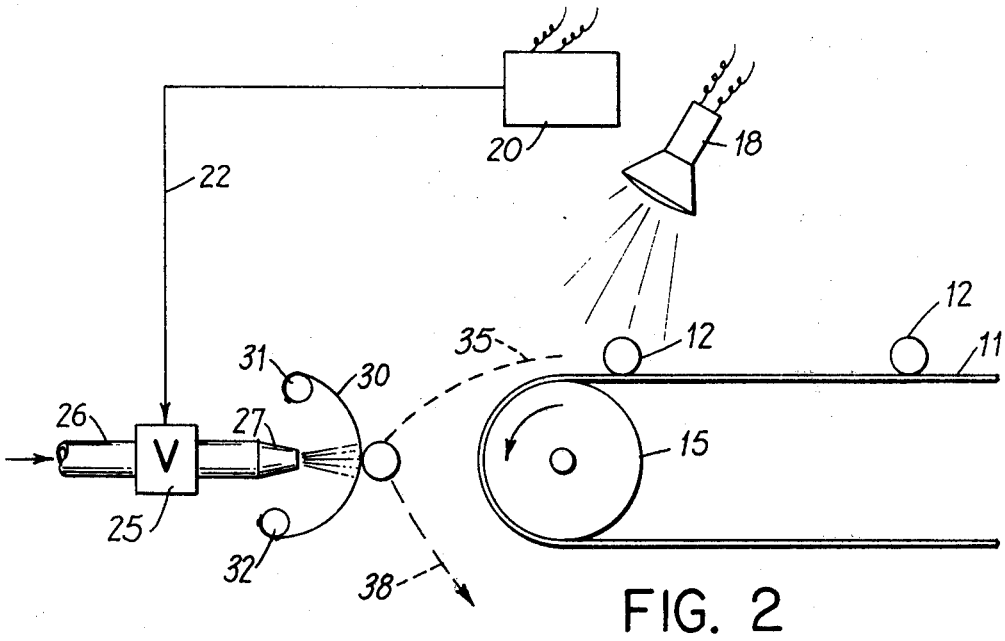
FIG. 2 is a simplified illustration of the apparatus of FIG. 1 showing the flexible, air impervious flap maintained in its taut condition by a blast of air acting against it.

When an article of produce 12 having less than optimum characteristics is detected by grading means 20, a signal is produced on output line 22, valve 25 is opened, and a blast of air is expelled from nozzle 27, as illustrated in FIG. 2. The air blast strikes the back surface of the substantially air impervious thin sheet of flexible material 30 and causes it to assume a somewhat taut and extended condition. In this its operative condition, sheet 30 is interposed into the free fall path 35. An article of produce to be sorted strikes the taut sheet 30 and is deflected along a second path 38 that is angularly disposed relative to free fall path 35, thereby sorting the article from others having optimum characteristics.

Sheet 30 is wide enough to assure that it will intercept and deflect an article emanating from a row of aligned articles on conveyor belt 11. There may be a number of aligned rows of articles on conveyor belt 11. In that case, grading means and ejection means including a sheet 30 will be associated with each row of articles.

Sheet 30 in front of nozzle 27 captures much more of the air blast than would the rounded and smooth surfaces of a tomato or apple, for example, and thus makes available for ejecting an article much more of the force of the air blast. This means that the source supplying the air blast need not have as great a volume and pressure capacity as would be required without the sheet 30. This is an important consideration when the apparatus illustrated in the drawings is mounted on movable harvesting equipment that is used in the field.

A sheet 30 of flexible material is presently preferred because it will minimize bruises on the sorted articles of produce. However, a freely pivoted and more rigid sheet could be employed if it will not adversely affect the sorted article. In such case, the more rigid sheet would be freely pivoted about rod 31 and would hang down out of the free fall path in the absence of an air blast. An air blast from nozzle 27 would pivot the more rigid sheet into the free fall path to deflect an article therefrom.

While a preferred embodiment of the invention has been illustrated and described, it is to be understood that alterations and modifications may be made to the described embodiment without departing from the scope of the present invention.

What is claimed is:

1. In produce grading apparatus where articles of produce on a conveyor are successively passed by an inspection position and grading means produces a signal in response to an inspected article of given characteristics, and wherein articles having said given characteristic are to be ejected from a path at the discharge of said conveyor, improved ejection means comprising, means responsive to said signal for expelling a blast of fluid toward said path, an open flexible sheet of substantially air impervious material suspended adjacent said path and in front of the means for expelling a blast of fluid, whereby the suspended open sheet will receive a blast of fluid against one side thereof, said sheet assuming an inoperative position in the absence of a fluid blast and assuming an operative position when a fluid blast is incident thereon, said inoperative position being outside of said path and said operative position intersecting said path to eject an article of said given characteristic therefrom.

2. In produce grading apparatus where articles of produce on a conveyor are successively passed by an inspection position and grading means produces a signal in response to an inspected article of given characteristics, and wherein articles having said given characteristic are to be ejected from a path at the discharge of said conveyor, improved ejection means comprising, fluid means responsive to said signal for directing a fluid blast in the direction of said path, an open sheet of flexible, substantially air impervious material suspended at opposite edges thereof between said fluid means and said path and positioned to receive the fluid blast on one side thereof, said sheet having a sufficient length between said edges that in the absence of said fluid blast said sheet assumes a drooping inoperative position out of said path and when said blast is incident on said one side thereof said sheet assumes an extended operative position intercepting said path to eject from the path an article of said given characteristic.

3. Apparatus claimed in claim 2 wherein said fluid means includes a nozzle for directing said fluid blast against one side of the flexible sheet.

4. In produce grading apparatus where articles of produce on a conveyor are successively passed by an inspection position and grading means produces a signal in response to an inspected article of given characteristics, and wherein articles are discharged from said conveyor along a free fall path and articles of said given characteristic are to be ejected from said free fall path, improved ejection means comprising, air blast means adjacent said path and responsive to said signal for emitting an air blast in the direction of said path, a thin sheet of flexible substantially air impervious material suspended in front of said air blast means, first and second sheet suspension means extending horizontally above and below, respectively, the air blast for suspending said sheet therebetween to intercept the air blast, said sheet being open and of a length greater than the distance between the suspension means, whereby said sheet sags out of the free fall path in the absence of said air blast, the length of the sheet being sufficient to place the sheet in said free fall path when the air blast is incident thereon to extend it to an extended or taut condition, whereby articles of said given characteristic following said free fall path will strike the extended and taut sheet and will be ejected from said path.

* * * * *